US005664588A

United States Patent [19]

Berry

[11] Patent Number: 5,664,588

[45] Date of Patent: Sep. 9, 1997

[54] CURLING IRON HAVING SKIN PROTECTING SHIELD

[76] Inventor: Luticia L. Berry, 1031 W. 106th St., Los Angeles, Calif. 90044

[21] Appl. No.: 638,604

[22] Filed: Apr. 29, 1996

[51] Int. Cl.[6] ..... A45D 1/06

[52] U.S. Cl. ..... 132/232; 132/236

[58] Field of Search ..... 132/224, 231, 132/232, 229, 234, 236, 269; 219/222, 223, 225, 226

[56] References Cited

U.S. PATENT DOCUMENTS

| | | | |
|---|---|---|---|
| 1,376,416 | 5/1921 | Forshee | 132/232 |
| 1,719,232 | 7/1929 | Meade | 132/269 |
| 1,847,479 | 3/1932 | Godefroy | 132/224 |
| 4,464,562 | 8/1984 | Takimae | 132/232 |
| 4,695,704 | 9/1987 | Andis | 132/232 |

*Primary Examiner*—Todd E. Manahan
*Attorney, Agent, or Firm*—Roger A. Marrs

[57] ABSTRACT

A shield for protecting the facial skin of a person using a heated curling iron that provides two pairs of sleeves cooperatively carried on the heating element and the clamp member of the curling iron so that the portion of hair to be curled may be wound about the heating element between spaced apart sleeves. The shields or presence of the sleeves shields and protects the heating element from contacting the skin of the user.

7 Claims, 1 Drawing Sheet

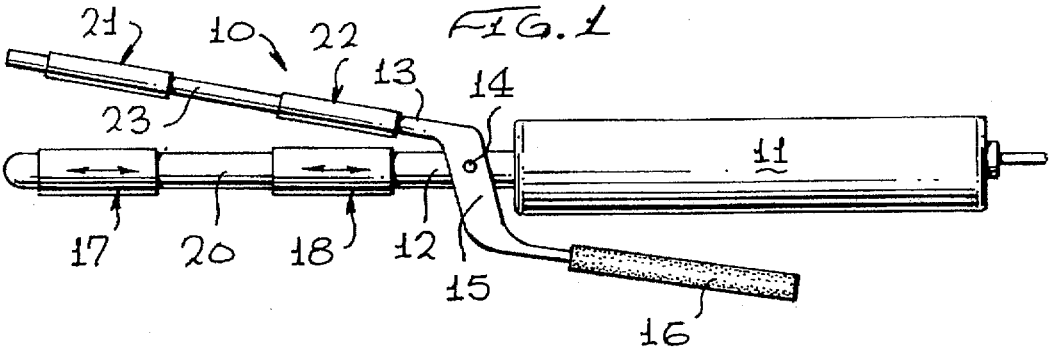
FIG. 1
FIG. 2
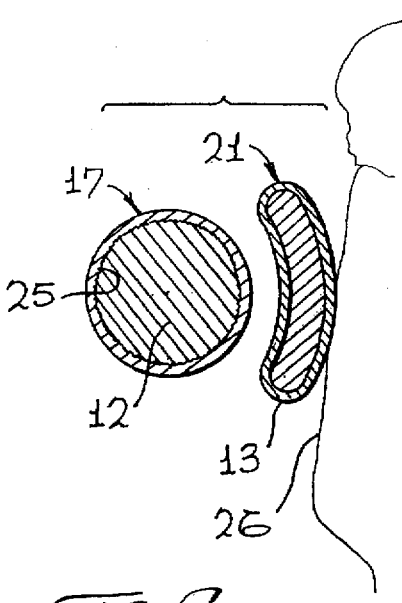
FIG. 3
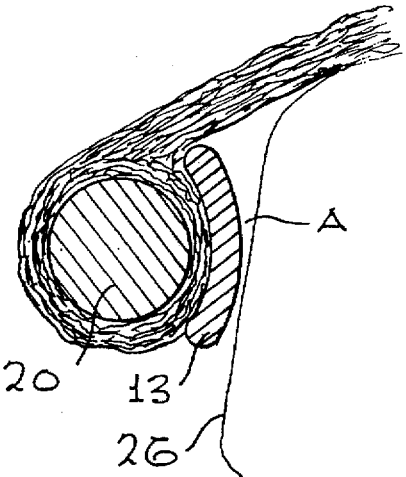
FIG. 4
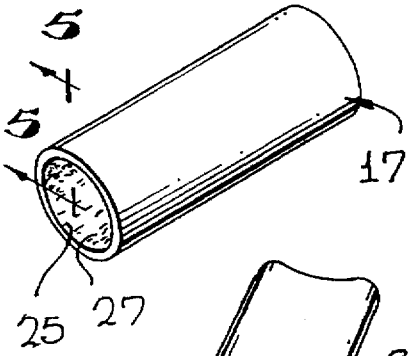
FIG. 5
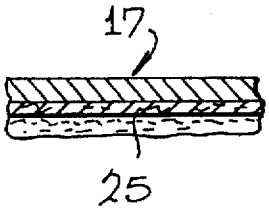
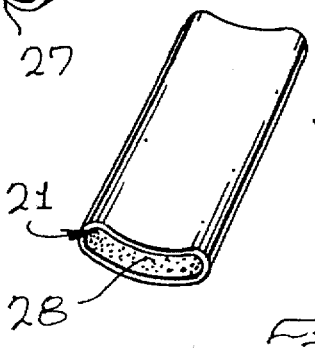
FIG. 6
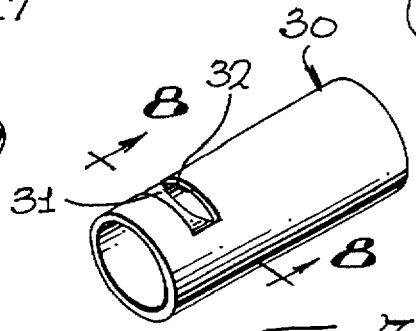
FIG. 7
FIG. 8
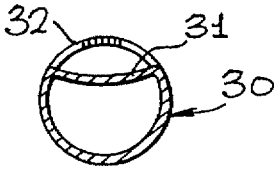

CURLING IRON HAVING SKIN PROTECTING SHIELD

BACKGROUND OF THE INVENTION

1. Field of the Invention

The present invention relates to the field of curling irons, and more particularly to a novel shield mountable on the heating elements of a hair curling iron which permits a tuft of hair to be curled while preventing the heating element from coming into contact with the skin of the user.

2. Brief Description of the Prior Art

Conventionally, it is the practice to curl one's hair by employing a curling iron having a pair of heating elements arranged in a scissor-like manner whereby a portion of hair may be wrapped about the heating element while held in place. Problems and difficulties have been encountered with conventional heating irons which stem from the fact that during the curling procedure, the heating element sometimes comes in contact with the skin of the user's forehead or facial areas which causes serious burns and skin damage. It is not always possible for the user to hold the heating element far enough away from the user's forehead during the curling procedure and yet obtain the desired results by curling the hair portion.

Therefore, a long-standing need has existed to provide a means for protecting the facial skin of the user during a hair curling process so that serious damage and injury is avoided. Such a means should be capable of being mounted on conventional heating elements of heating irons and must suitably separate the heating iron from the user's facial skin during the curling procedure.

SUMMARY OF THE INVENTION

Accordingly, the above problems and difficulties are avoided by the present invention which provides a novel shielding arrangement comprising at least one insulative sleeve slidably mountable on the heating element of a curling iron such that the sleeve may readily contact the skin of the user without transmitting heat from the heating element to the skin. In one form of the invention, a pair of sleeves is carried on the heating element in a series and which sleeves are spaced-apart so as to expose a central portion of the heating element about which a tuft or portion or hair is to be wrapped or curled. A similar pair of sleeves is mounted in spaced-apart relationship on a holding element of the heating iron and they are arranged in mateable relationship with the sleeves on the heating iron so that the tuft of hair is maintained between all of the sleeves. Each of the respective sleeves is composed of a heat insulating material and each sleeve is conformed to the cross-sectional shape of the element on which it is mounted. For example, the sleeve on the heating element is circular to match the cross-section of the heating element while the sleeves carried on the holding lever or element are of semicircular configuration to match the semicircular cross-section of the holding element. Several means are provided for retaining the sleeves onto their respective elements, such as providing a roughened interior bore surface engaging with each of the exterior surfaces of the elements, employing a suitable adhesive or releasable contact adhesive or employing a resilient spring arrangement.

Therefore, it is among the primary objects of the present invention to provide a novel means for protecting the skin of a user from burn and injury when using a heated curling iron.

Another object of the present invention is to provide a novel hair curling iron having means carried on the heating element for shielding the user's skin from heated contact with the surface of the heating element.

Yet another object of the present invention is to provide a novel shielding means detachably carried on the heating elements of a hair curling iron which separates the heating element from the skin of the user during a hair curling procedure.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a side elevational view of a curling iron with the shielding means of the present invention carried on its heating element;

FIG. 2 is an enlarged transverse cross-sectional view of the heating elements illustrated in connection with the heating iron of FIG. 1;

FIG. 3 is a view similar to the view of FIG. 2 illustrating a tuft of hair being curled;

FIG. 4 is a front perspective view showing the shield of the present invention in the form of a cylinder so as to be carried on the heating element of the curling iron;

FIG. 6 is a front perspective view of a sleeve to be carried on the holding element of the curling iron as shown in FIGS. 1 and 2;

FIG. 5 is an enlarged fragmentary cross-sectional view of the sleeve shown in FIG. 4 as taken in the direction of arrows 5—5 thereof;

FIGS. 7 and 8 are perspective and transverse cross-sectional views respectively of another embodiment of the present invention showing spring retention means for holding the sleeve onto the elements of the heating iron.

DESCRIPTION OF THE PREFERRED EMBODIMENT

Referring now to FIG. 1, the novel shield for a heating element on a curling iron is indicated in the general direction of arrow 10. The heating iron includes a handle 11 and a heating element 12 is illustrated as projecting outwardly from one end of the handle 11. A holding element 13 is pivotally carried on the heating element 12 by means of a pivot 14 disposed on a midsection 15 of the element 13. One end of the element 13 includes a cushioned pad or the like, indicated by numeral 16, while the opposite end of element 13 outwardly projects for approximately the same length as the heating element 12. It is understood that the curling iron is of an electrical type for heating the element 12 and this does not form a part of the present invention.

FIG. 1 also illustrates that the heating element 12 is provided with a pair of shields 17 and 18 which take the form of sleeves that have been inserted over the free end of the element 12 and slid along its length into the positions shown so that the sleeves are arranged in series but spaced apart so as to expose a central portion 20 of the heating element about which a shock of hair is to be wound. Furthermore, it can be seen that the element 13 also includes a pair of shields 21 and 22 which are slid over the free end of element 13 and arranged in spaced-apart relationship.

This exposes a central portion 23 of the element 13 and this central area of the element matches the midsection 20 of the element 12. Therefore, the user will commence the curl of a portion of hair by wrapping the portion about the central area 20 of the heating element 12 followed by manipulating the element 13 to close adjacent to the element 12 whereby the portion of hair to be curled will reside against the midsection 23 of element 13 for releasably holding the hair portion in position for curling.

Referring now in detail to FIG. 2, it can be seen that the shield 17 is of cylindrical configuration including a central bore which is provided with a roughened or low contact adhesive surface 25. This surface engages the exterior surface of the heating element or rod 12 whereby the user may position the sleeve along the length of the heating element to a desired location. It can also be seen that the element 13 is of semicircular cross-section and that the sleeve 21 follows this configuration. The sleeve 21 includes a central bore which is in slidable relationship with respect to the element 13 so that the sleeve or shield may be positioned to match the positioning of the shield on the heating rod 12. The skin of the forehead of the user is indicated by numeral 26 and it can be seen that the shields 17 and 21 provide an insulative barrier so that the heat from either of the elements cannot touch of be transferred to the skin of the user. A space is illustrated between the external surface of the shield 17 and the concave surface of the shield 21 whereby the portion of hair intended to be curled is disposed about the central area 20 of the element 12 and not between the opposing surfaces of the elements 17 and 21.

Referring to FIG. 3, it can be seen that the uncovered external surfaces of the heating rod or element 12 are wrapped about its midsection 20 with the portion of hair intended to be curled so that that portion of hair occupies the space between the opposing surfaces of the heating rod 12 and the element 13. A space, represented by the letter A, is present between the skin and the backside of the element 13 due to the thickness of the shields 21 and 22. Since the thickness of the walls for the shields 21 and 22 maintains the element 13 away from the skin, the distance is illustrated by the letter A. Should the user rotate the heater so that the element 12 approaches the skin of the user, the thickness of the shields 17 and 18 will prevent contact.

Referring now in detail to FIG. 4, the cylindrical sleeve 17 is illustrated and it can be seen that the configuration includes a continuous open-ended bore 27 and that the exposed inner surface of the bore may be coated with a low-contact adhesive or may be toughened in order to provide limited frictional retention.

In a similar fashion, the semicircular shield 21 is illustrated having an open-ended arcuate bore 28 which exposes a low contact adhesive or roughened material in order to provide limited frictional retention. When the shields 17 and 18 are slid over the heating element 12, they are spaced apart between their opposing ends so as to define a space therebetween and exposing the midsection 20 of the rod or element 12. In a similar fashion, the shields 21 and 22 are arranged on element 13 so that their opposing ends expose the midsection 23 of the element 13.

As an example of releasable contact with the heating element, FIG. 5 illustrates the roughened or low contact adhesive 27 which is carried on the internal bore surface of the sleeve or shield 17.

Referring now to FIGS. 7 and 8, another means is illustrated for releasably retaining the respective shields onto their respective elements. For example, a cylindrical shield 30 is illustrated having a portion 31 deflecting into the open-ended bore of the shield so as to yieldably interfere with the entrance of the rod 12 into the bore. When the end of the rod is inserted into the bore, the tip will press against the element 31 which will yield into a slot 32 while at the same time applying releasable pressure against the element 12. By this means, a releasable tension is provided to maintain the sleeve in position on the element 12. The same type of resilient and yieldable retention may be incorporated into the semicircular shields 21 and 22, if desired.

Accordingly, it can be seen that the shields of the present invention provide a means for preventing contact between the heated elements of the iron and the skin of the user. At the same time, a central area is exposed on the heating elements which provides for a lock or portion of hair to be curled thereon.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A curling iron comprising:

a curling iron having an elongated heating element projecting from a handle;

an elongated clamp member pivotally carried on said heating element adjacent to said handle;

a first pair of sleeves slidably carried on said heating element in spaced apart relationship to define an exposed surface area of said heating element for receiving a portion of hair intended to be curled;

a second pair of sleeves slidably carried on said clamp member in spaced apart relationship in a critical location directly opposite to said first pair of sleeves so as to engage therewith; and means carried on each sleeve of said first and said second pair of sleeves for yieldably retaining said sleeves in said critical location on said respective heating element and clamp member.

2. The invention as defined in claim 1 wherein:

said heating element is of circular cross section and said clamp member is of an arcuate semi-circular cross section;

said first pair of sleeves being of cylindrical configuration to fit over said heating element and said second pair of sleeves being of arcuate semi-circular configuration to fit over said clamp member.

3. The invention as defined in claim 2 wherein:

said cylindrical sleeves and said arcuate semi-circular sleeves include opposite and opposing conforming surfaces.

4. The invention as defined in claim 3 wherein:

each of said cylindrical sleeves and each of said semi-circular sleeves provide a wall thickness that when combined during engagement provide a hair curl winding space about said heating element established between said pair of sleeves on said heating element.

5. The invention as defined in claim 4 wherein:

said yieldable retaining means for each of said sleeves includes a low contact adhesive frictional joining said sleeves with said heating element and said clamp member respectively.

6. The invention as defined in claim 4 wherein:

said yieldable retaining means for each of said sleeves includes a resilient element integrally carried on each of said sleeves releasably bearing against said heating element and said clamp member.

7. The invention as defined in claim 4 wherein:

said sleeves are composed of a non-heat absorbing material.

* * * * *